US011426015B2

(12) United States Patent
Hill

(10) Patent No.: US 11,426,015 B2
(45) Date of Patent: Aug. 30, 2022

(54) SLEEPING BAG WITH TOP FLAP

(71) Applicant: Bright Path Enterprises LLC, Layton, UT (US)

(72) Inventor: Aaron Hill, Layton, UT (US)

(73) Assignee: Bright Path Enterprises LLC, Layton, UT (US)

( * ) Notice: Subject to any disclaimer, the term of this patent is extended or adjusted under 35 U.S.C. 154(b) by 29 days.

(21) Appl. No.: 16/269,446

(22) Filed: Feb. 6, 2019

(65) Prior Publication Data

US 2019/0239664 A1 Aug. 8, 2019

Related U.S. Application Data

(60) Provisional application No. 62/627,526, filed on Feb. 7, 2018.

(51) Int. Cl.
*A47G 9/08* (2006.01)
*A47G 9/10* (2006.01)

(52) U.S. Cl.
CPC ..... *A47G 9/08* (2013.01); *A47G 9/086* (2013.01); *A47G 9/1045* (2013.01)

(58) Field of Classification Search
CPC ..... A47G 9/08; A47G 9/1045; A47G 9/086; A41D 23/00; A41D 3/02; A41D 1/06; A41D 1/04; A41D 2023/004; A45F 4/00
See application file for complete search history.

(56) References Cited

U.S. PATENT DOCUMENTS 2,888,009 A 5/1959 Taylor
4,033,001 A 7/1977 Kern
4,787,105 A * 11/1988 Phillips ..... A47G 9/086 128/201.13
4,989,282 A 2/1991 Goldstein
(Continued)

FOREIGN PATENT DOCUMENTS

FR 2358132 A1 2/1978
GB 662960 A 12/1951
(Continued)

OTHER PUBLICATIONS

International Search Report and Written Opinion from PCT/US2019/017089, dated Apr. 8, 2019.
(Continued)

*Primary Examiner* — David R Hare
*Assistant Examiner* — Madison Emanski
(74) *Attorney, Agent, or Firm* — Maschoff Brennan

(57) ABSTRACT

A sleeping bag may include a top flap with a head opening for the user's head to fit through and the opening may form a comfortable seal around the user's neck. The top flap may transition over the user's shoulders, transition down underneath the user's head, and extend beyond the top of the user's head. Advantageously, the sleeping bag may offer a unique way to comfortably close the top of a sleeping bag to prevent air draft and heat loss. The sleeping bag may allow users to more comfortably sleep in multiple positions, including side sleepers, stomach sleepers, back sleepers, fetal sleepers, etc. The sleeping bag may provide a soft place to lay one's head while allowing the user to sleep in a position with their hands and arms above their shoulders, while still keeping them under cover of the top layer of the sleeping bag.

20 Claims, 10 Drawing Sheets

(56) References Cited

U.S. PATENT DOCUMENTS

| | | | | |
|---|---|---|---|---|
| 5,815,833 | A * | 10/1998 | Kuo | A41D 15/04 2/69.5 |
| 2005/0028277 | A1 | 2/2005 | Gordon et al. | |
| 2008/0256705 | A1 | 10/2008 | Maguire | |
| 2011/0173749 | A1 | 7/2011 | Martray | |
| 2012/0180213 | A1 | 7/2012 | Storms | |
| 2012/0324647 | A1 | 12/2012 | McKee | |
| 2014/0345051 | A1 | 11/2014 | Benninger | |

FOREIGN PATENT DOCUMENTS

| | | | | |
|---|---|---|---|---|
| WO | WO 85/04316 | A1 | 10/1985 | |
| WO | WO-8504316 | A1 * | 10/1985 | A47G 9/086 |

OTHER PUBLICATIONS

International Search Report and Written Opinion from PCT/US2019/022837, dated Jun. 3, 2019.

* cited by examiner

SLEEPING BAG WITH TOP FLAP

CROSS-REFERENCE TO RELATED APPLICATION

This application claims priority to and the benefit of U.S. Provisional Patent Application Ser. No. 62/627,526, entitled SLEEPING BAG, which was filed on Feb. 7, 2018, which is hereby incorporated by reference in its entirety.

BACKGROUND

Field

The present disclosure generally relates to sleeping bags.

Background

Sleeping bags have long been known, and are widely used. The sleeping bags commonly used today may be divided in three general categories: traditional, hooded, or a hybrid of the two.

Traditional sleeping bags are long rectangle-shaped bags with an opening at the top. A traditional sleeping bag is shown in FIG. 1.

Hooded sleeping bags have a long tube-shaped body, with a hood that wraps up over the top of one's head. The hood normally has a drawstring and cord lock to cinch the hood down around one's face. These sleeping bags are commonly referred to as mummy bags. A hooded or mummy sleeping bag is shown in FIG. 2.

There are sleeping bags that are a hybrid of the two categories, combining design elements from both hooded sleeping bags and traditional shaped sleeping bags. A hybrid sleeping bag is shown in FIG. 3.

BRIEF SUMMARY

Known sleeping bags may have a number of drawbacks or disadvantages.

There are four significant problems with the traditional type of sleeping bag. First, the top of the traditional type of sleeping bag is open and does not seal shut. Users of the traditional type of sleeping bag experience draftiness and heat loss during use because the opening at the top of the sleeping bag allows cooler air to enter and warmer air to escape out of the sleeping bag. Second, many people sleep with their hands and arms above their shoulders. In the traditional type of sleeping bag, if a person places their hands and arms above their shoulders while laying inside of the sleeping bag, their hands and arms are exposed to open air and the environment. Third, many people prefer the comfort of having the sleeping bag under their head or the side of their face while laying inside of the sleeping bag. In the traditional type of sleeping bag, a person would need to zip a corner of the sleeping bag down to allow for laying with part of the sleeping bag under the person's head, exposing the person's shoulders and neck to cooler air outside of the sleeping bag. Fourth, to avoid the aforementioned problems, some people duck their heads down inside of the traditional type of sleeping bag and breathe inside the sleeping bag. This introduces moisture from respiration into the inside of the sleeping bag, which may cause the sleeping bag to become damp, cold, and uncomfortable.

While the hooded design may be excellent for eliminating draftiness and heat loss, a significant problem with hooded sleeping bags is discomfort. People who sleep in different positions, or who sleep with hands and arms above their shoulders, find the hooded design to be confining, restrictive, and uncomfortable. Generally, a person cannot roll inside a hooded sleeping bag because the face opening extends upwardly from the top side of the sleeping bag. Rolling on the person's side, or stomach, inside a hooded sleeping bag would place the person's face to the side of the hood, and the sleeper's ear at the opening. In order to keep the person's face in the face opening, the person would be required to remain on their back or to roll with the sleeping bag.

Hybrid sleeping bags have a hybrid of the problems explained with the aforementioned categories. Hybrid sleeping bags sacrifice some issues for others.

A need therefore exists for a sleeping bag that eliminates or diminishes the above-described disadvantages and problems.

Three elements for a comfortable sleeping include: (1) provide insulation—a sleeping bag needs to minimize air draft, keeping warm air in and cold air out, to do this effectively; (2) accommodate different sleep positions and allow users to sleep as they are accustomed on their side, stomach, or back; and (3) provide sufficient sleep space to allow users to comfortably move, change position, and sprawl in their natural sleep position and movement (for example, allowing the hands and/or arms to be above the shoulders and head while remaining covered and inside the sleeping bag). Traditional, hooded, and hybrid sleeping bag designs do not adequately accommodate all three of these elements.

An aspect is a sleeping bag that may include a top flap. The top flap may include a pass-through head opening and extended sleep chamber, which may accommodate all three elements for a comfortable sleeping bag. For example, the pass-through head opening and a extended sleep chamber may allow one to seal off the top of the sleeping bag so that warm air stays inside the bag and cooler air stays outside. This seal may significantly increase heat retention and/or efficiency of the sleeping bag. A person is generally not comfortable if they are cold or chilled while laying inside of the sleeping bag. The seal may be around the neck-area of the user rather than around the face. The extended sleep chamber may continue underneath the head and may extend past the height of the user. A user may have their arms and hands above their shoulders and head and still have their arms and hands within the extended chamber and/or under the cover of the top flap. The pass-through head opening and extended sleep chamber may offer a user significantly increased freedom to sleep in a position in which they are most comfortable. For example, the user may roll side to side or back to stomach inside the sleeping bag without allowing significant air loss or removing hands and arms from inside the extended sleep chamber.

Another aspect is a sleeping bag that may include a body portion with a bottom layer and a top layer, a top flap coupled with the body portion, a head opening in the top flap, and a sleep chamber. The sleep chamber may include a first portion between the bottom layer and the top layer of the body portion, and a second portion within the top flap. The first portion and the second portion of the sleep chamber may be sized and configured to receive a portion of a user of the sleeping bag.

Still another aspect is a sleeping bag that may include a body opening that is sized and configured to allow a user to enter the sleep chamber. The sleep chamber may be sized and configured to receive a body of the user, one or more arms of the user, and at least part of the neck and shoulders of the user. The sleep chamber may be sized and configured to enclose a user, and the head opening in the top flap may be sized and configured to allow a head of the user to extend through the head opening during use. A portion of the sleep chamber may extend beyond a top of a head of a user. The sleep chamber may extend from a sealed end of the body portion to a sealed end of the top flap, and the user may be positioned between the sealed end of the body portion and the sealed end of the top flap during use.

Yet another aspect is the top flap may cover at least a portion of a body opening, which may help prevent air flow into or out of the sleep chamber. The top flap may form a seal around at least a portion of the neck of a user during use. The body portion and the top flap may be integrally constructed as part of a unitary, one-piece structure. For example, the top flap may form part of or be an extension of the bottom layer of the body portion that may extend beyond the top of a head of a user. Alternatively, the body portion and the top flap may be independently constructed as two separate, distinct structures and may be configured to be joined or coupled, as desired. For example, the body portion and the top flap may be joined or coupled by the user, as desired.

A portion of the top flap may cover at least a portion of the shoulders of a user and at least a portion of the top flap may be disposed beneath the head of the user. The top flap may at least partially seal an opening to the sleep chamber. In addition, a portion of the sleep chamber may be disposed underneath a head of a user.

Still yet another aspect is a head of a user may be positioned at least proximate an outer surface of the top flap during use. The sleeping bag may include a head mat connected to the top flap, and the head mat may be sized and configured to receive the head of a user during use.

A further aspect is a sleeping bag may include a body portion with a width and a length; a top flap connected to the body portion, the top flap including a receiving portion that is sized and configured to receive the hands or arms of a user; a head opening in the top flap, the head opening in communication with the receiving portion of the top flap; and a sleep a chamber disposed in the body portion, the sleep chamber in communication with the receiving portion of the top flap to allow a portion of the body of the user to be disposed within the sleep chamber and the hands or arms of the user to be disposed in the receiving portion of the top flap while the head of the user is disposed in the head opening in the top flap. A width of the top flap may be generally equal to or greater than the width of the body portion.

These and other aspects, features and advantages of the present invention will become more fully apparent from the following brief description of the drawings, the drawings, the detailed description of preferred embodiments, and appended claims.

DETAILED DESCRIPTION OF THE FIGURES

The appended drawings contain figures of exemplary embodiments to further illustrate and clarify the above and other aspects, advantages, and features of the present invention. It will be appreciated that these drawings depict only exemplary embodiments of the invention and are not intended to limit its scope. Additionally, it will be appreciated that while the drawings may illustrate preferred sizes, scales, relationships and configurations of the invention, the drawings are not intended to limit the scope of the claimed invention. The invention will be described and explained with additional specificity and detail through the use of the accompanying drawings in which:

DETAILED DESCRIPTION OF THE EMBODIMENTS

Figure 1:
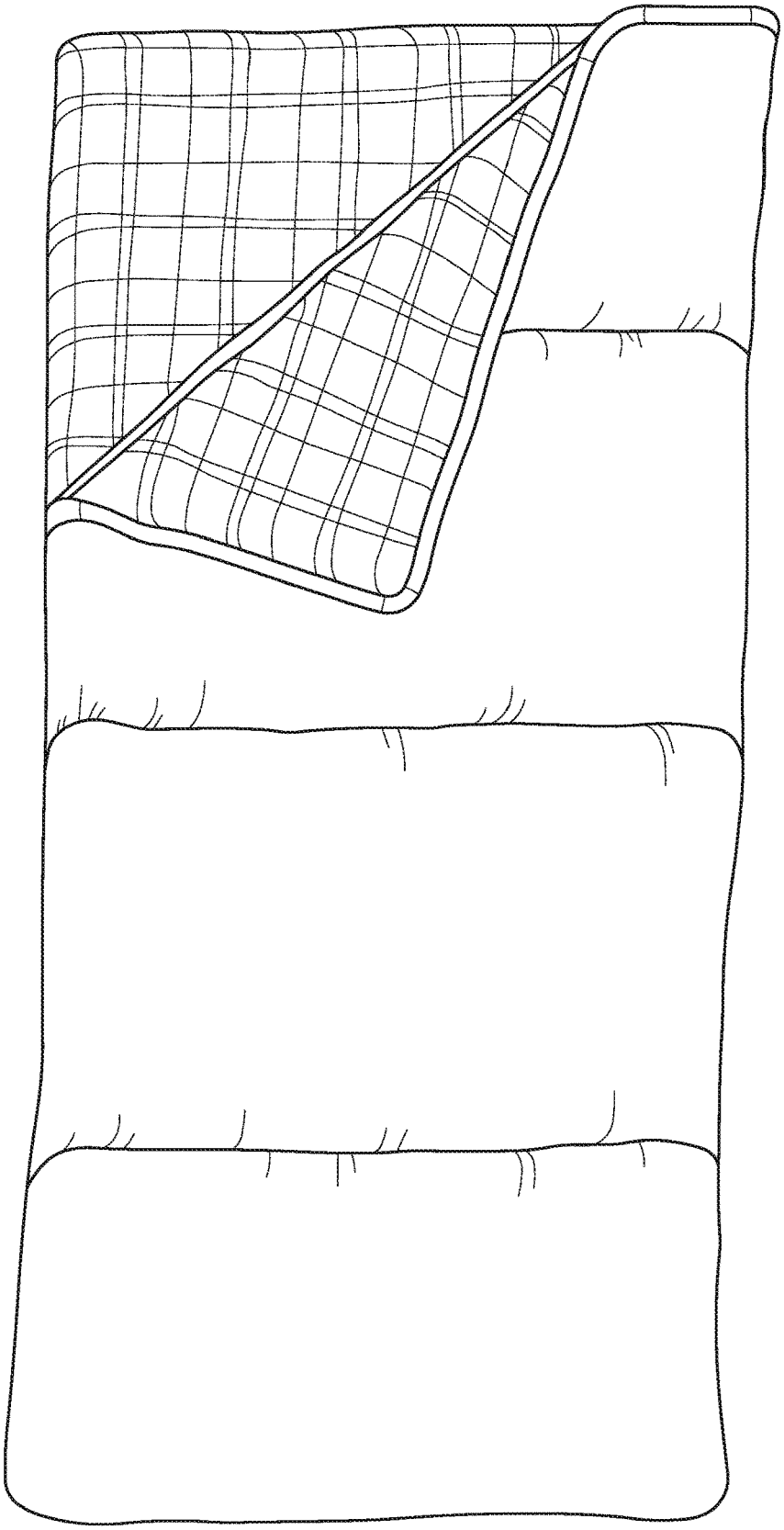
FIG. 1 Prior Art
FIG. 1 is an example of a traditional sleeping bag.
Figure 2:
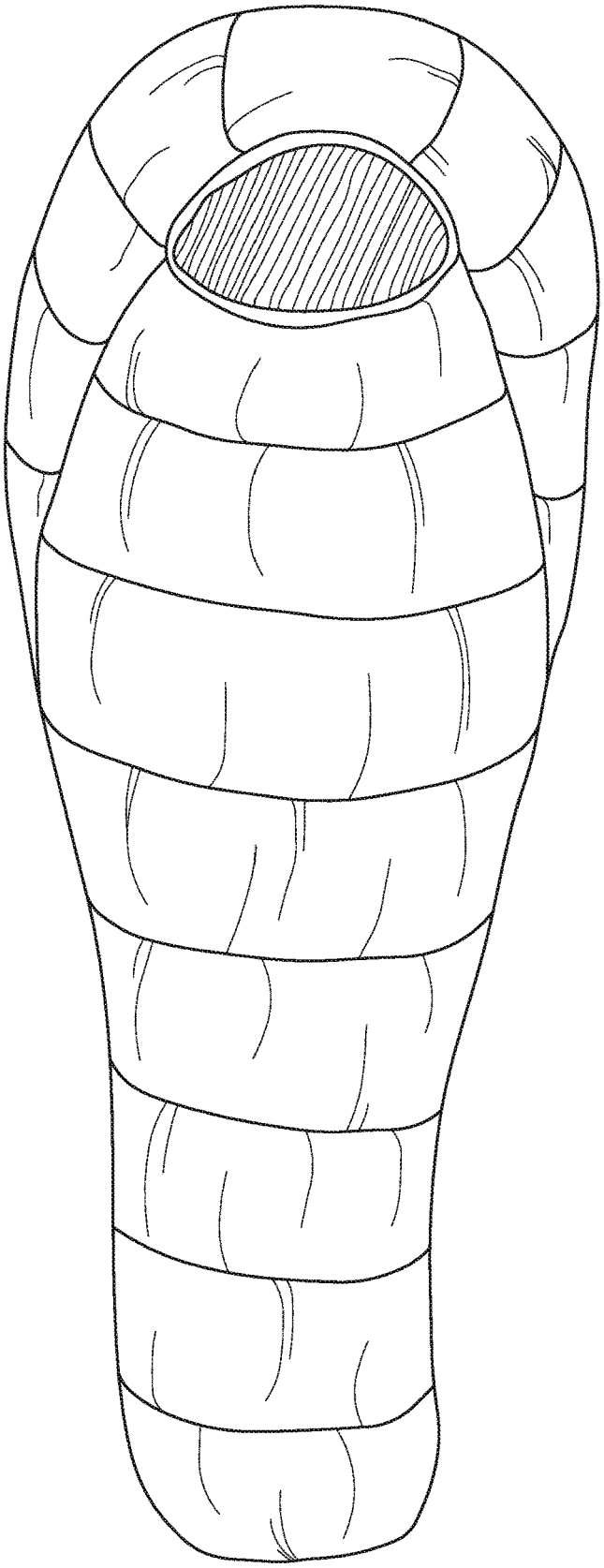
FIG. 2 Prior Art
FIG. 2 is an example of a hooded sleeping bag, commonly called a mummy bag.
Figure 3:
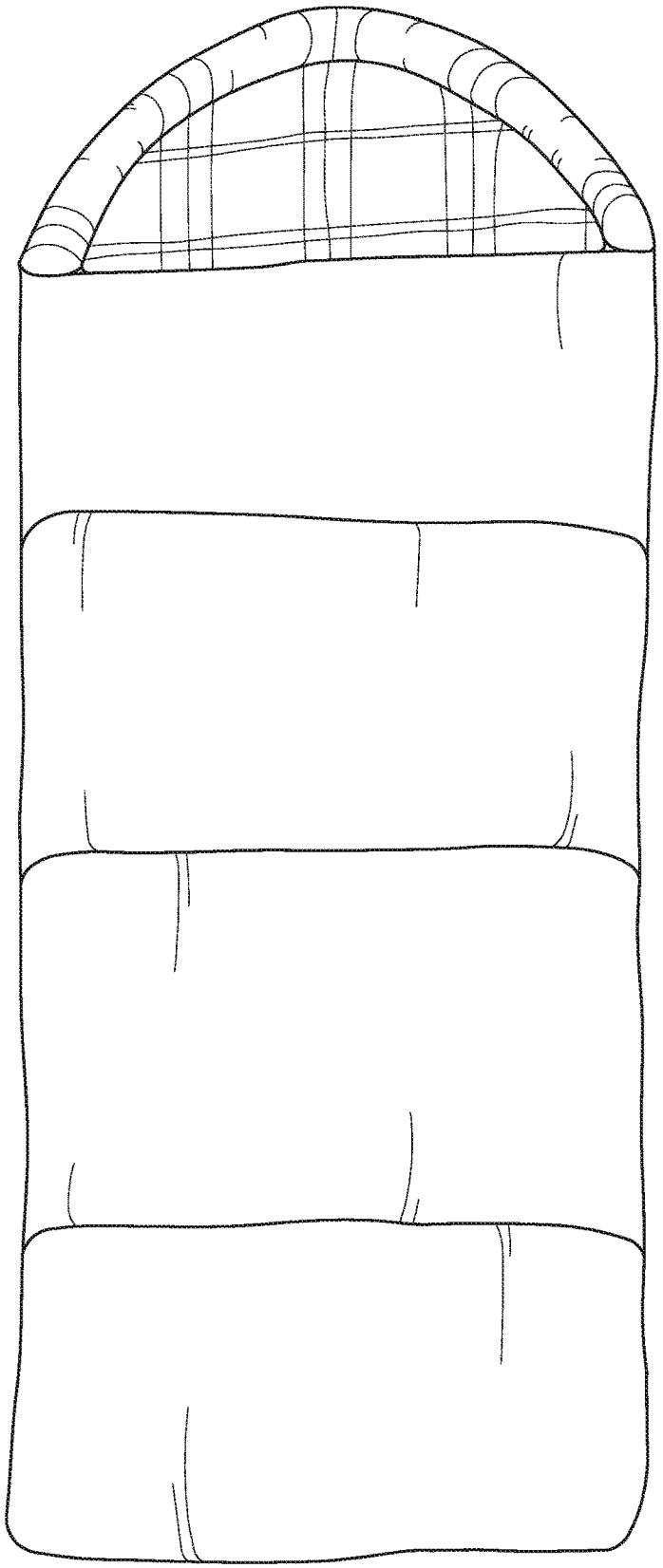
FIG. 3 Prior Art
FIG. 3 is an example of a hybrid sleeping bag combining elements from the traditional sleeping bag, and a hooded sleeping bag.

The following exemplary embodiments are generally described in connection with sleeping bags. The principles of the present invention, however, are not limited to sleeping bags. In particular, the principles of the sleeping bag may be implemented in other articles or structures. In addition, it will be understood that, with the benefit of the present disclosure, the sleeping bag may have a variety of shapes, sizes, configurations, and arrangements. Moreover, while the sleeping bags shown in the accompanying figures may be shown in a particular configuration, it will be appreciated the sleeping bag may have other suitable styles, arrangements, and configurations. Further, the sleeping bag disclosed herein and components thereof may be successfully used in connection with other types of articles and structures.

To assist in the description of exemplary embodiments of the sleeping bag, words such as top, bottom, front, rear, right and left may be used to describe the accompanying figures which may be, but are not necessarily, drawn to scale. It will further be appreciated the sleeping bag may be disposed in a variety of desired positions or orientations, and used in numerous locations, environments and arrangements.

The description of exemplary embodiments of the sleeping bag may also be clarified by the following wording. While the wording may clarify exemplary embodiments of the sleeping bag, one skilled in the art will understand the wording may have other a meanings after reviewing this disclosure.

A sleeping bag may be a blanket or quilt formed into a long tube. A sleeping bag is generally closed on the foot and sides. A sleeping bag may form into portable bedding and is normally used when sleeping outdoors. The primary purpose of many sleeping bags is to provide warmth and thermal insulation. A secondary use of many sleeping bags is to provide padding and comfort from the ground.

A bottom layer or bottom panel may be the underneath layer between the ground and the user that the user lays on. The top layer or top panel may be the layer on top of the user. The bottom layer and/or the top layer may be configured, arranged, and/or oriented in such a way to promote heat retention and/or efficiency of the sleeping bag.

The foot portion of the sleeping bag may be the lower part of the bag where the user's feet are typically disposed. The foot portion of the sleeping bag may also be referred to as the foot or distal end of the sleeping bag.

The head portion of the sleeping bag may be the upper part of the sleeping bag where the user's head is typically disposed. The head portion of the sleeping bag may also be referred to as the head or proximate end of the sleeping bag.

The shell portion of the sleeping bag may be the outer layer of fabric that is normally in contact with the open air and/or ground. The shell could be made with polyester, nylon, cotton, or the like. The shell and/or the fabric of the shell may be configured, arranged, and/or oriented in such a way to promote heat retention and/or efficiency of the sleeping bag.

The liner portion of the sleeping bag may be the inner fabric that is normally in contact with the person inside the bag. The liner is often made with fabric that is soft and comfortable to the touch such as flannel or a synthetic. The liner and/or the fabric of the liner may be configured, arranged, and/or oriented in such a way to promote heat retention and/or efficiency of the sleeping bag.

The fill may be the insulation that is placed in between the liner and the shell. The fill may be natural materials (e.g., goose down), or man-made materials (e.g., polyester fiberfill). The fill or insulation may be configured, arranged, and/or oriented in such a way to promote heat retention and/or efficiency of the sleeping bag.

The sleep chamber may be the area between the top layer and bottom layer of the sleeping bag where a user normally sleeps. In traditional sleeping bags, the sleep chamber is open at the top. In an exemplary embodiment of the sleeping bag, a top flap may be incorporated into the design such that the sleep chamber is closed or sealed around the user's neck, which may leave the entire body of the user, other than the user's head, sealed inside the sleep chamber.

The top flap may be at least partially disposed above the head of the user. For example, the top flap may be a panel of fabric that is used to drape from the shoulders of the user and extend in length beyond the top of the head. The top flap may consist of an outer shell, insulation, and/or a liner. The outer shell, insulation, and/or liner of the top flap may be configured, arranged, and/or oriented in such a way to promote heat retention and/or efficiency of the sleeping bag.

The top flap may consist of an inner region and an outer region. The inner region may come into contact with the neck, head, and/or face of the user and may have a softer fabric, or liner, sewn on top of, or used in place of the fabric that may be used for the outer shell. The inner region may have an opening for a user's head to pass through, and then the opening may seal comfortably around the neck and/or head of the user, which may prevent air drafts and/or heat loss proximate the shoulders, neck, and/or head of the user. The pass-through head opening may have a flange or collar disposed around the perimeter of the opening, and the flange or collar may increase the comfort of the user and/or help seal out air drafts and/or heat loss. An exemplary purpose of the top flap is to close the top of a sleeping bag, connect the top and bottom layers of the sleeping bag in a manner that extends the sleep chamber over the shoulders, under the head, and beyond the head of the user.

The user may be a person using or sleeping in the sleeping bag.

A detailed description of some exemplary embodiments of the sleeping bag now follows. After reviewing this disclosure, one of ordinary skill in the art will appreciate that the sleeping bag may have other suitable shapes, sizes, configurations, and/or arrangements depending, for example, upon the intended use of the sleeping bag.

Figure 4A:
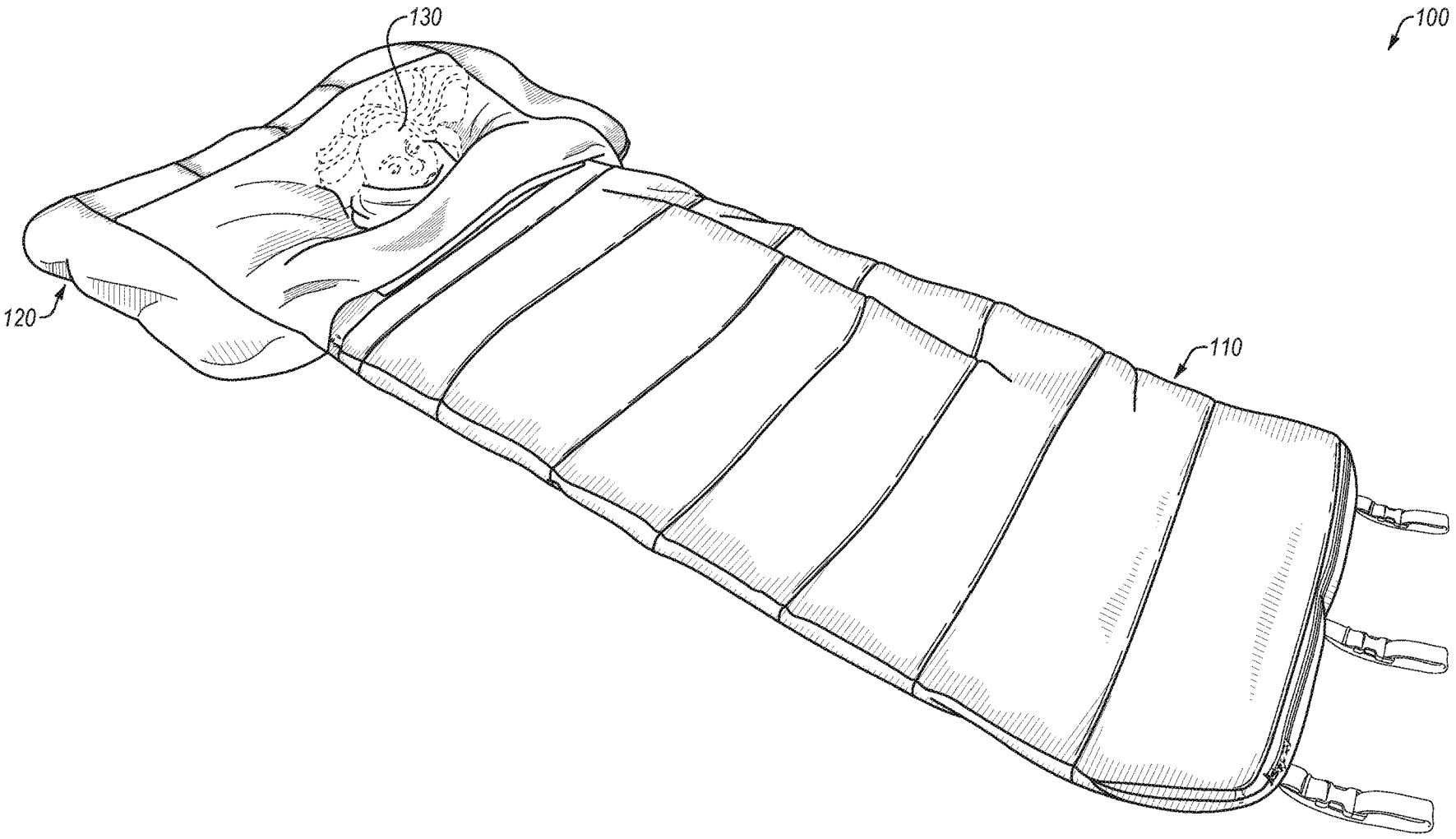
FIG. 4A is an upper perspective view of an exemplary embodiment of a sleeping bag, illustrating a person using the sleeping bag. The sleeping bag is laid out flat with the bottom layer facing down and the top layer facing up.
Figure 4B:
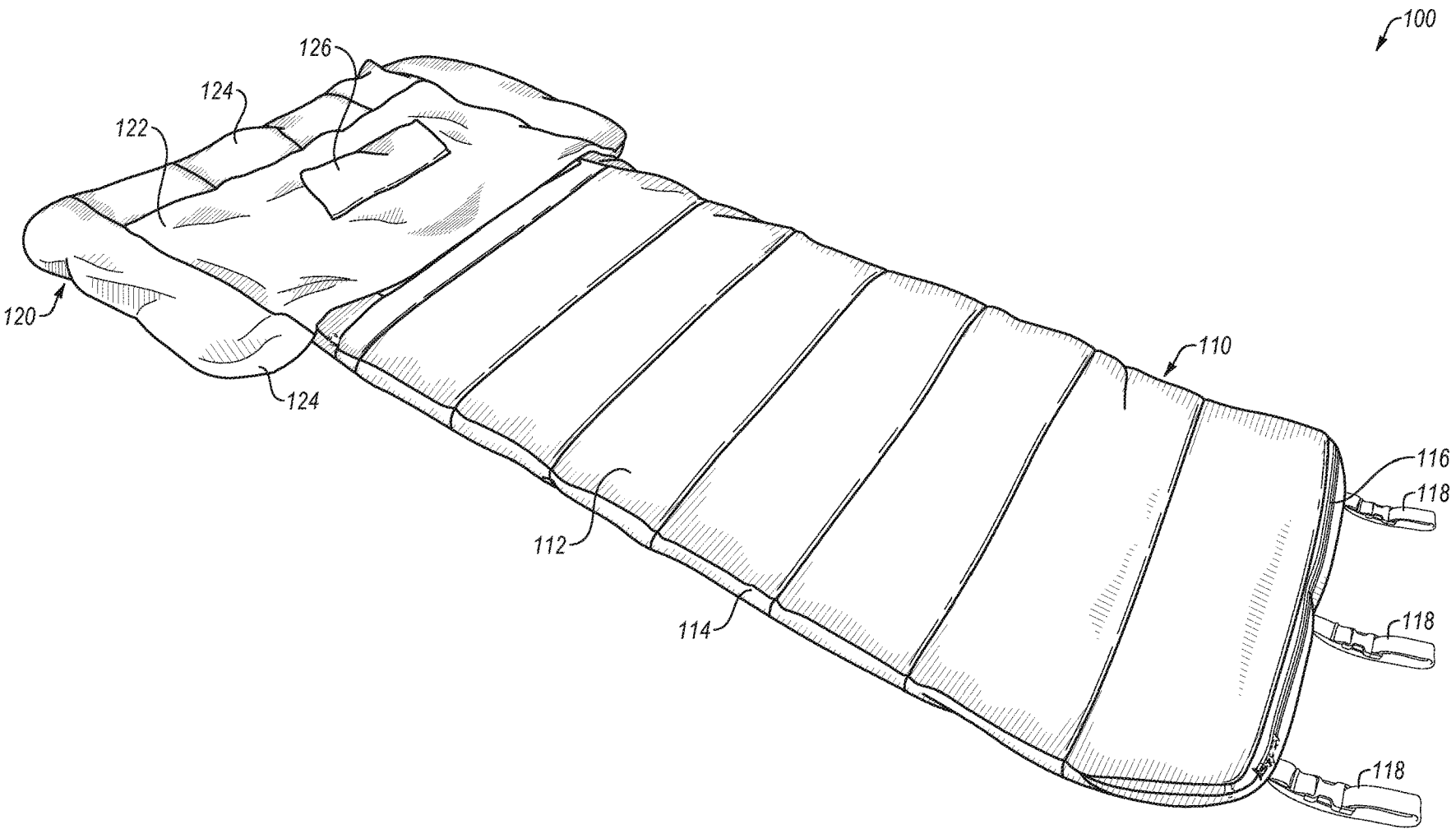
FIG. 4B is an upper perspective view of an exemplary embodiment of a sleeping bag.

FIGS. 4A and 4B illustrate an upper perspective view of an exemplary embodiment of a sleeping bag 100. FIG. 4A illustrates a user 130 resting inside of the sleeping bag 100. The sleeping bag 100 may include a body portion 110 and a top flap 120. As shown in FIG. 4B, the body portion 110 may include a top layer 112 and a bottom layer 114 formed in a long tubular shape. The top layer 112 and bottom layer 114 may be coupled on the sides and at the foot of the body portion 110. One or both sides of the body portion 110 may have a zipper 116 running full length, or partial length to create a way to open the bag and get in, and then zip it shut.

The zipper 116 may run across all or part of the length of the foot, which may allow venting at the foot portion of the sleeping bag 100 or opening the sleeping bag into a flat rectangle. One or more straps 118 may be disposed proximate the foot portion of the sleeping bag 100. The sleeping bag 100 and/or body portion 110 may be rolled and/or folded into a more compact configuration and secured in the desired position using the one or more straps 118. The straps 118 may also facilitate storage and/or transport of the sleeping bag 100.

The top or head of the body portion 110 of the sleeping bag 100 may have an opening wherein the top edge or head edge of the top layer 112 and the top edge or head edge of the bottom layer 114 are not coupled. Because this opening may be above the head, arms, and/or hands of the user 130, the top flap 120 may form a seal because it may lay flat on top of the bottom layer 114. This opening may be sewn shut, or closed with a zipper, button, snap, etc.

The head edge of the top layer 112 and the head edge of the bottom layer 114 may be coupled at the head of the body portion 110. For example, the head edge of the top layer 112 and the head edge of the bottom layer 114 may be coupled at the head of the body portion 110 with the zipper 116 for opening and shutting.

The top flap 120 may be coupled to the body portion 110. The body portion 110 and the top flap 120 may be integrally constructed as part of a unitary, one-piece structure. For example, the top flap 120 may form part of or be an extension of the bottom layer 114 of the body portion 110 that may extend beyond the top of a head of a user. Alternatively, the body portion 110 and the top flap 120 may be independently constructed as two separate, distinct structures and the body portion 110 and the top flap 120 may be joined or coupled, as desired.

The top flap 120 may be coupled to the body portion 110 such that the entire body of the user 130, other than the head of the user 130, may be sealed inside the sleep chamber. The top flap 120 may be permanently sewn to the body portion 110, or may be detachable by employing a zipper(s), button(s), snap(s), clip(s), hook and loop(s) or other fastening methods.

The top flap 120 may be coupled to the top layer 112. For example, the top flap 120 may be coupled to one or more edges or sides of the top layer 112. For instance, the top flap 120 may be coupled to the top layer 112 at or near the head edge of the top layer 112. The top flap 120 may be coupled to the top layer 112 at shoulder height of the user 130. The top flap 120 may be coupled to the top layer 112 such that the coupling may act as an axis of rotation for the top flap 120. For example, the top flap 120 may be rotated about the coupling in a first direction such that a top side of the top flap 120 is exposed.

The top flap 120 may be rotated about the coupling in a second direction such that a bottom side of the top flap 120 is exposed. The top flap 120 may be folded, up, to the side, or back down over the user 130 when not in use.

The top flap 120 may be coupled to the bottom layer 114. For example, the top flap 120 may be coupled to one or more edges or sides of the bottom layer 114. In an exemplary embodiment, the top flap 120 may be coupled to the bottom layer 114 at or near the head edge of the bottom layer 114. The top flap 120 may be coupled to the top layer 112 and/or the bottom layer 114 such that the entire body of the user 130, other than the head of the user 130, is disposed inside the body portion 110 and top flap 120.

The top flap 120 may include an inner region 122, an outer region 124, and a head opening 126. The inner region 122 and the outer region 124 may be coupled on the sides and/or at the head of the inner region 122. The outer region 124 may create a border around one or more sides of the inner region 122.

The one or more sides of the inner region 122 may be coupled to the top layer 112 of the body portion 110. The inner region 122 may include material and/or padding. The inner region 122 may support the head and/or neck of the user 130.

The outer region 124 may include material and/or padding. The outer region 124 may provide support to the head and/or neck of the user 130. The outer region 124 may extend out past the sides and/or head of the body portion 110, which may create more surface area within which the user 130 can extend their hands and arms above their shoulders and head within the sleep chamber and/or remain under the coverage of the top flap 120. The user 130 may also extend their hands and arms outside of the sleep chamber and/or the top flap 120, if necessary.

The head opening 126 in the top flap 120 may be large enough for an adult to pass his or her head through. The head opening 126 may come into contact with the neck, head, and/or face of the user 130 and may use a softer fabric, or liner, sewn on top of, or used in place of the fabric that may be used for the outer region 124 and/or the top flap 120. The head opening 126 may comfortably seal around the neck of the user 130. The head opening 126 may seal around the neck of the user 130 using buttons or a zipper, similar to the neck of a shirt. The head opening 126 may seal around the neck of the user 130 similar to an elastic waistband on gym shorts. The head opening 126 may seal around the neck of the user 130 similar to a fly on a men's pair of briefs or underwear. The head opening 126 may seal around the neck of the user 130 similar to the opening on a t-shirt with stretchy fabric. The head opening 126 may seal around the neck of the user 130 similar to a drawstring on the collar of a coat or sweatshirt, or any other manner (such as a snap, clip, or hook and loop) to comfortably seal the fabric around the neck to minimize airflow and heat loss from the sleep chamber. After reviewing this disclosure, one of ordinary skill in the art will appreciate that the head opening 126 may be sealed around the neck of the user 130 using other suitable arrangements and/or configurations.

The top flap 120 may include a head mat to provide additional support and/or comfort to the user 130 of the sleeping bag 100. The head mat may be coupled or disposed a with the inner region 122 of the top flap 120. For example, the head mat may be disposed near the area configured to receive the neck, face, and/or head of the user 130. The head mat may use a softer fabric, or liner, sewn on top of, or used in place of the fabric that may be used for the inner region 122 and/or the outer region 124. The head mat may be any size or shape. For example, the head mat may include fabric cut and/or sewn in a half-circle shape.

Figure 5:
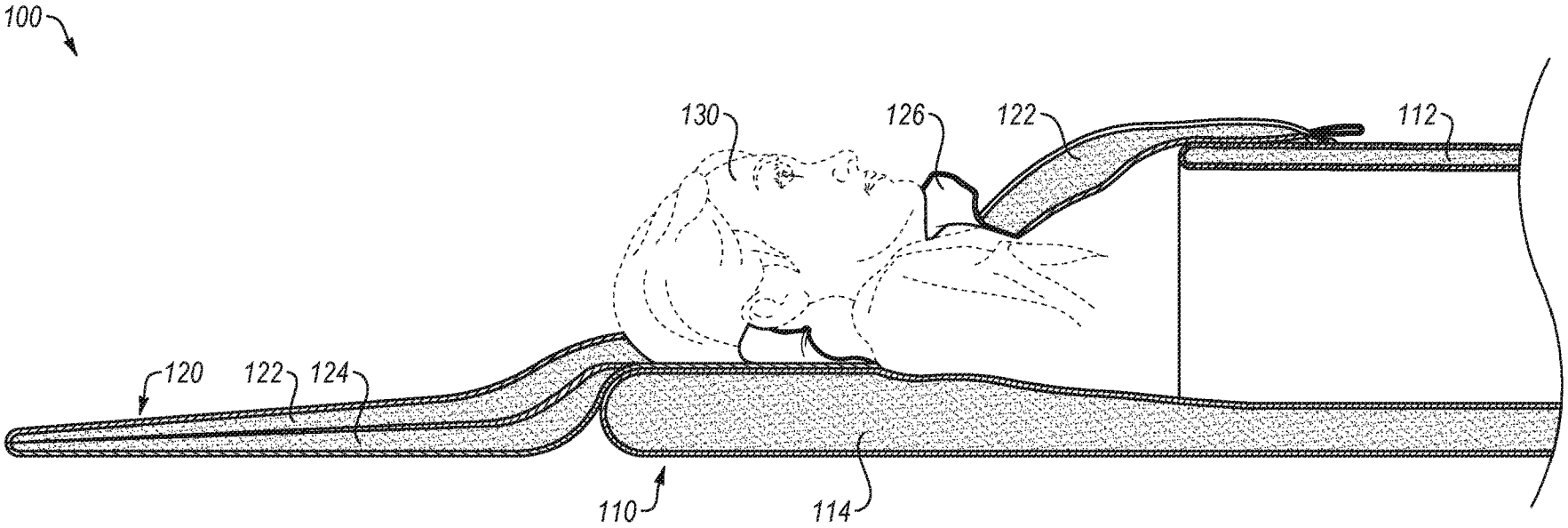
FIG. 5 is a cross section of a side perspective view of an exemplary embodiment of a sleeping bag, illustrating a user laying on her back.

FIG. 5 shows a cross sectional side view of an exemplary embodiment of the sleeping bag 100 with the user 130 resting inside. The top layer 112 and the bottom layer 114 of the body portion 110 may be disposed between the ground (not shown) and at least a portion of the top flap 120 when the sleeping bag 100 is laid out flat with the top layer 112 facing up and disposed above the user 130 and the bottom layer 114 facing down and disposed below the user 130.

The user 130 may insert their head into the head opening 126 and the top flap 120 may drape over the shoulders of the user 130. The top flap 120 may also extend under the head of the user 130, lie flat against the bottom layer 114, and continue for a distance past the head of the user 130. The top flap 120, draping over the bottom layer 114, may form a seal at the top of the body portion 110, which may help to trap the warmer air inside of the sleep chamber.

Figure 6A:
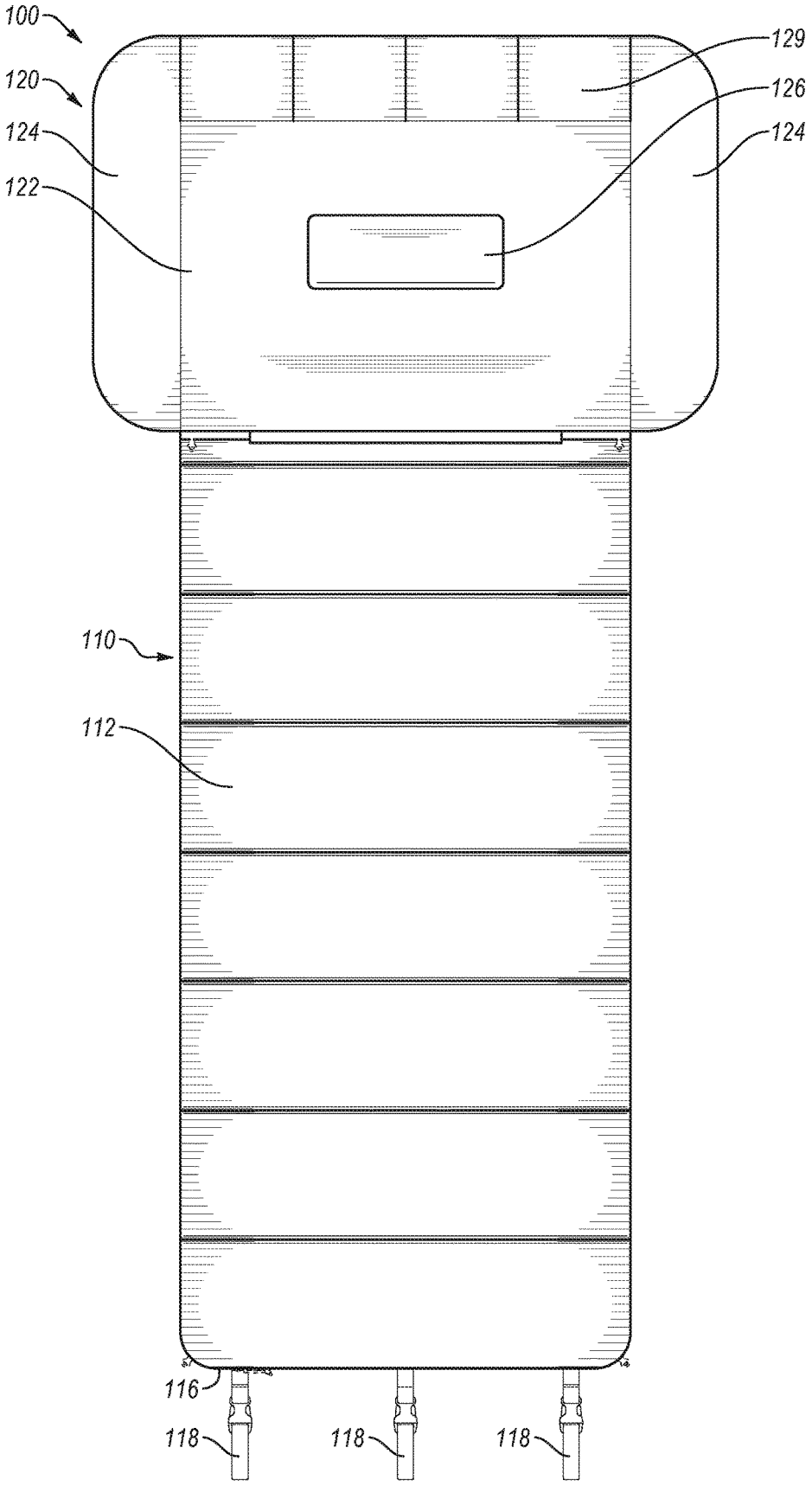
FIG. 6A is a top view of an exemplary embodiment of a sleeping bag.

FIG. 6A shows a top view of an exemplary embodiment of the sleeping bag 100. The sleeping bag 100 is shown in a laid out flat configuration with the top layer 112 facing up and the bottom layer 114 (not shown) facing down.

Figure 6B:
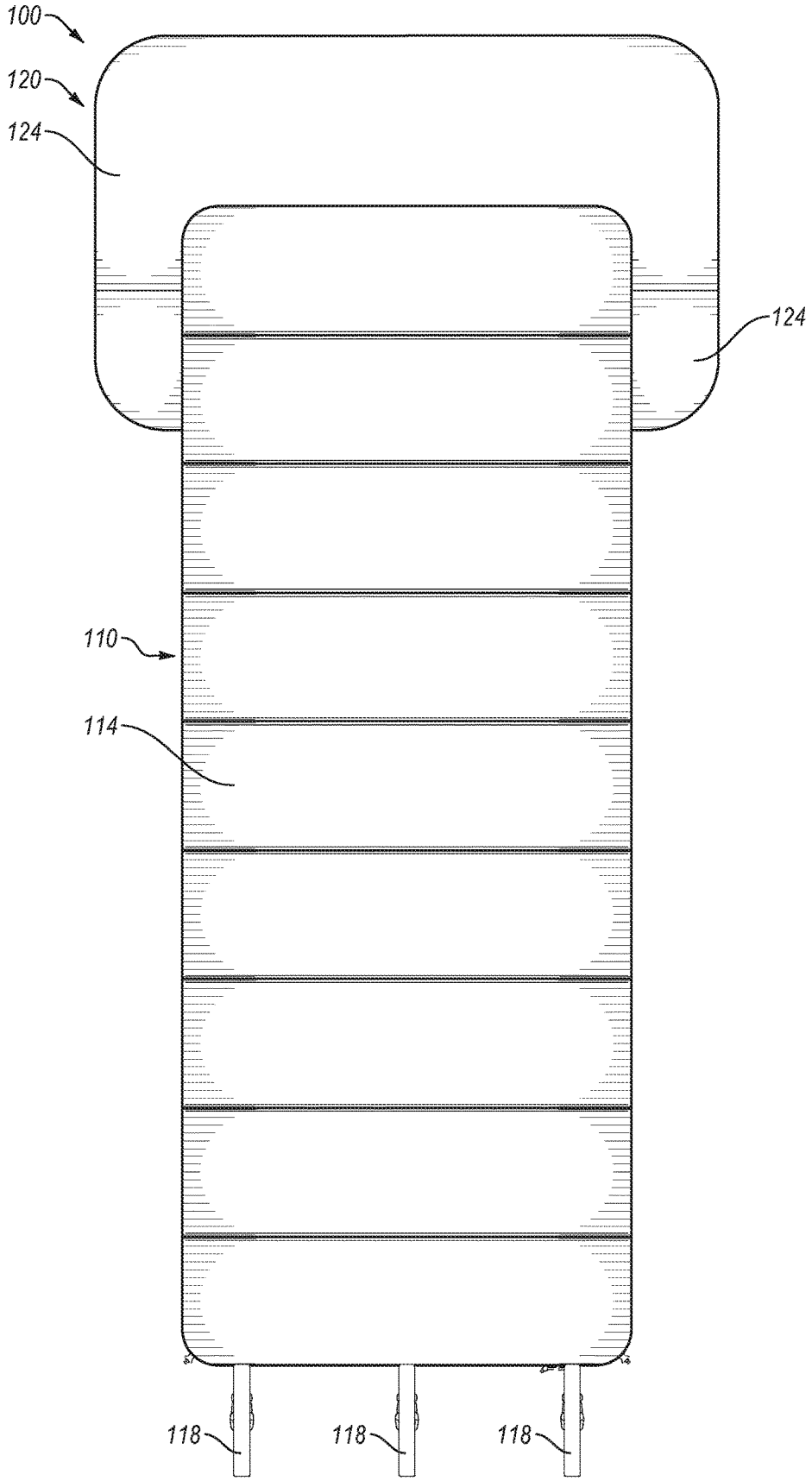
FIG. 6B is a bottom view of the sleeping bag shown in FIG. 6A.
Figure 7A:
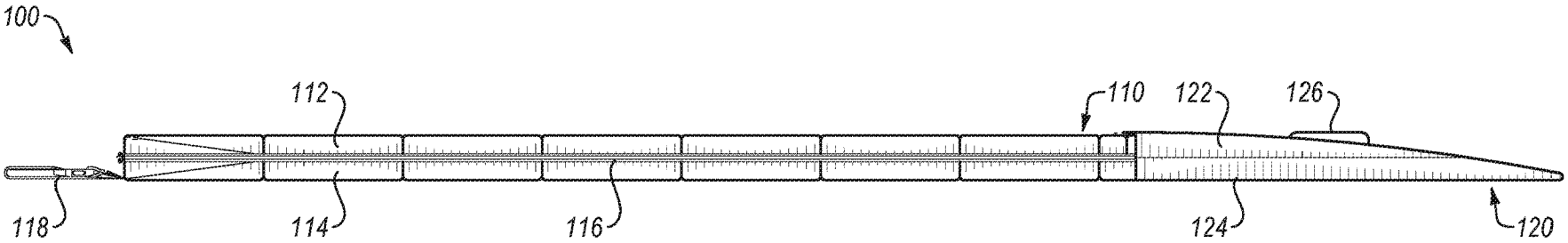
FIG. 7A is a side view of the sleeping bag shown in FIG. 6A.

FIG. 6B is a bottom perspective view of an exemplary embodiment of the sleeping bag 100. The sleeping bag 100 is shown in the laid out flat configuration with the a bottom layer 114 facing up and the top layer 112 (not shown) facing down. As shown in FIG. 6B, the top flap 120 may extend above the head edge of the body portion 110 when the top flap 120 is coupled to the body portion 110 at shoulder height of a user FIG. 7A is a side view of an exemplary embodiment of a sleeping bag 100. As shown in FIG. 7A, the zipper 116 may extend from the foot of the body portion 110 and along the side of the body portion 110 to the head edge of the body portion 110.

Figure 7B:
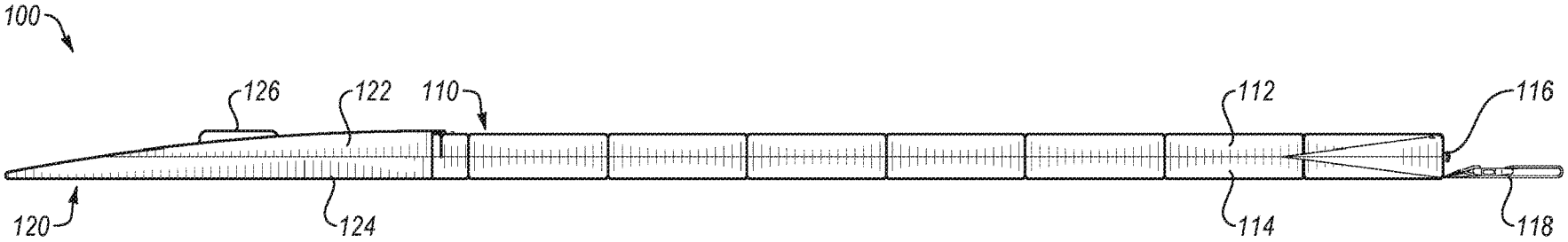
FIG. 7B is another side view of the sleeping bag shown in FIG. 6A.

FIG. 7B shows an opposite side view of the sleeping bag 100 of FIG. 7A. As shown in the accompanying figures, the zipper 116 may extend from the foot of the body portion 110 and along the side of the body portion 110 (not shown) to the head edge of the body portion 110.

Figure 8A:
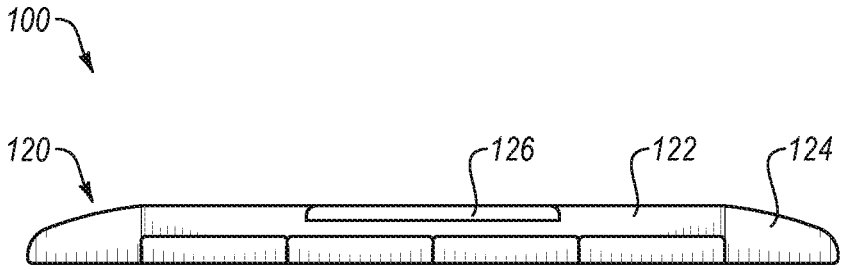
FIG. 8A is a front view of the sleeping bag shown in FIG. 6A.
Figure 8B:
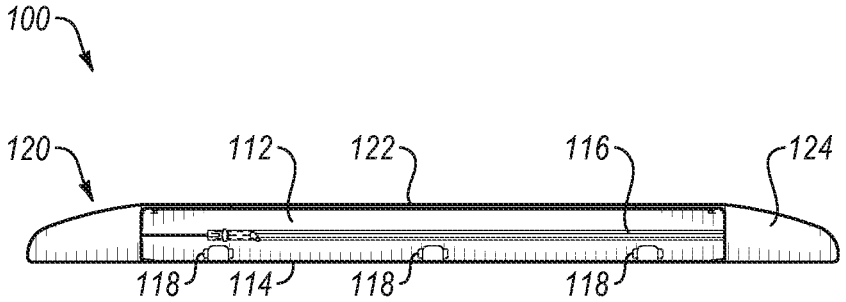
FIG. 8B is a rear view of the sleeping bag shown in FIG. 6A.

FIG. 8A shows a front view of an exemplary embodiment of the sleeping bag 100. FIG. 8B shows a rear view the sleeping bag 100 of FIG. 8A. As shown in FIG. 8B, the zipper 116 may extend across all or part of the entire length of the foot of the body portion 110.

One of ordinary skill in the art may appreciate after reviewing this disclosure that the sleeping bag disclosed herein may have a number of different aspects, features, characteristics and configurations. Further, a sleeping bag may have any suitable number of aspects, features, characteristics and configurations depending, for example, upon the intended use of the sleeping bag.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A sleeping bag comprising:

a body portion including a bottom layer and a top layer;

a top flap coupled with the body portion, the top flap including a receiving portion that is sized and configured to receive hands or arms of the user, an upper portion of the top flap disposed above a head of a user and a lower portion of the top flap configured to cover shoulders of the user;

a head opening disposed in the inner region of the top flap, the head opening spaced apart from outer edges of the top flap, the head opening sized and configured to allow a head of the user to pass through the head opening during use, the head opening sized and configured to form a seal around a neck-area of the user; and a sleep chamber comprising:

a first portion of the sleep chamber in the body portion of the sleeping bag; and a second portion of the sleep chamber in the top flap, the first portion and the second portion of the sleep chamber sized and configured to receive a portion of the user when the sleeping bag is being used.

2. The sleeping bag as in claim 1, further comprising a body opening sized and configured to allow the user to enter the sleep chamber.

3. The sleeping bag as in claim 1, wherein the sleep chamber is sized and configured to receive a body of the user, one or more arms of the user, and at least part of the neck and shoulders of the user; and wherein the top flap is sized and configured to allow one or more hands or arms of the user to be disposed above or to a side of the user's head.

4. The sleeping bag as in claim 1, wherein the head of the user is positioned at least proximate an outer surface of the top flap during use.

5. The sleeping bag as in claim 1, wherein the body portion and the top flap are integrally constructed as part of a unitary, one-piece structure.

6. The sleeping bag as in claim 1, further comprising a head mat connected to the top flap, the head mat sized and configured to receive the head of the user during use.

7. The sleeping bag as in claim 2, wherein the top flap covers at least a portion of the body opening to help prevent air flow into or out of the sleep chamber.

8. The sleeping bag as in claim 1, wherein the top flap forms a seal around at least a portion of the neck of the user during use.

9. The sleeping bag as in claim 1, wherein the sleep chamber is sized and configured to enclose the user; wherein the upper portion of the top flap is at least partially disposed behind or above the user's head during use; and wherein the lower portion of the top flap is at least partially disposed below the user's head and at least partially covers a body opening to the sleeping bag during use.

10. The sleeping bag as in claim 1, wherein a portion of the top flap is disposed above the head of the user and the portion of the top flap is disposed beneath the head of the user.

11. The sleeping bag as in claim 1, wherein the top flap at least partially seals an opening to the sleep chamber.

12. The sleeping bag as in claim 1, wherein a portion of the sleep chamber is disposed underneath the head of the user.

13. The sleeping bag as in claim 1, wherein a portion of the sleep chamber extends beyond a top of the head of the user.

14. The sleeping bag as in claim 1, wherein the sleep chamber extends from a sealed end of the body portion to a sealed end of the top flap; and wherein the user is positioned between the sealed end of the body portion and the sealed end of the top flap during use.

15. The sleeping bag as in claim 1, wherein the top flap is connected to the bottom layer of the body portion.

16. The sleeping bag as in claim 1, wherein the top flap is connected to the top layer of the body portion.

17. The sleeping bag as in claim 1, wherein the top flap at least partially seals a body opening.

18. The sleeping bag as in claim 1, wherein the top flap is detachably connected to the body portion.

19. A sleeping bag comprising:

a body portion including a width and a length;

a top flap connected to the body portion, the top flap forming a receiving portion that is sized and configured to receive the hands or arms of the user, an upper portion of the top flap disposed above a head of the user, a lower portion of the top flap configured to cover shoulders of the user;

a head opening disposed in an inner region the top flap, the head opening in communication with the receiving portion of the top flap, the head opening spaced apart from outer edges of the top flap, the head opening sized and configured to allow the head of the user to pass through the head opening during use, the head opening sized and configured to form a seal about the user's neck area during use; and a sleep chamber disposed in the body portion, the sleep chamber in communication with the receiving portion of the top flap to allow a portion of the body of the user to be disposed within the sleep chamber and the hands or arms of the user to be disposed in the receiving portion of the top flap while the head of the user is disposed in the head opening in the top flap.

20. The sleeping bag as in claim 19, wherein a width of the top flap is generally equal to or greater than the width of the body portion.

* * * * *